United States Patent [19]

Petteys

[11] 3,986,383

[45] Oct. 19, 1976

[54] EXPANDER TOOL

[76] Inventor: Howard A. Petteys, 8980 E. Lansing Highway, Durand, Mich. 48429

[22] Filed: Mar. 26, 1975

[21] Appl. No.: 562,030

Related U.S. Application Data

[63] Continuation-in-part of Ser. No. 430,227, Jan. 2, 1974.

[52] U.S. Cl. ..... 72/393; 29/263; 269/48.1

[51] Int. Cl.[2] ..... B21D 41/02

[58] Field of Search ..... 72/393, 392, 370, 367; 29/255, 263, 282; 269/48.1

[56] References Cited

UNITED STATES PATENTS

| | | | |
|---|---|---|---|
| 1,625,131 | 4/1927 | Miller | 72/393 |
| 1,831,003 | 11/1931 | Holland | 29/263 |
| 2,226,078 | 12/1940 | Spahn | 269/48.1 X |
| 2,672,175 | 3/1954 | Howard | 72/393 |
| 2,899,741 | 8/1959 | Dunkerley | 29/263 |
| 2,991,674 | 7/1961 | Uhl | 72/393 |
| 3,077,916 | 2/1963 | Vaughn | 72/393 |
| 3,654,797 | 4/1972 | Skalsey | 72/393 |

*Primary Examiner*—C.W. Lanham
*Assistant Examiner*—James R. Duzan
*Attorney, Agent, or Firm*—Malcolm R. McKinnon

[57] ABSTRACT

An expander tool for truing thin walled tubing, the tool including improved means for equalizing expansion forces applied to expansion elements and other interrelated components incorporated in the tool, the tool also including improved clutch means for preventing over expansion of the tool and improved means for releasing the expansion elements and interrelated components when forces tending to expand the tool are reduced.

2 Claims, 6 Drawing Figures

EXPANDER TOOL

BRIEF SUMMARY OF THE INVENTION

This application is a continuation-in-part of the applicant's co-pending application Ser. No. 430,227, filed Jan. 2, 1974 for Expander Tool.

This invention relates to expander tools and, more particularly, to an improved expander tool incorporating improved means for truing thin walled tubing, such as engine mufflers, tail pipes and the like.

Heretofore, expander tools have been utilized for the purpose of eliminating troublesome grooves, dents and other defects in thin walled tubing such as engine mufflers, tail pipes and the like during the installation thereof. Tools of the type illustrated and described in U.S. Pat. Nos. 2,672,175 and 3,077,916 are illustrative of such prior art tools. However, prior expander tools of the indicated character have been subject to the defect that the expansion forces applied to the interrelated components thereof are applied unequally with the result that such interrelated components can become twisted and/or jammed in the workpiece. Prior expander tools are also difficult to release if excessive force is applied to the tools so as to over expand the tools beyond the expansion range with resultant loss of time and labor and increased expense for the user of the tool as efforts are expended in removing the twisted, jammed and/or over expanded tool from the workpiece.

An object of the present invention is to overcome the aforementioned as well as other disadvantages in prior expander tools of the indicated character, and to provide an improved expander tool incorporating improved means for equalizing the expansion forces applied to the interrelated components of the tool.

Another object of the invention is to provide an improved expander tool incorporating improved clutch means for preventing expansion of the interrelated components of the tool beyond the intended expansion range of the tool.

Another object of the invention is to provide an improved expander tool incorporating improved means for releasing the interrelated components thereof when forces tending to expand the tool are reduced or removed.

Another object of the invention is to provide an improved expander tool that is economical and commercially feasible to manufacture, assemble and use, durable, efficient and reliable in operation.

Still another object of the invention is to provide an improved expander tool that is relatively compact and which operates smoothly and efficiently without requiring heating or hammering of a workpiece.

The above as well as other objects and advantages of the present invention will become apparent from the following description, the appended claims and the accompanying drawings.

DETAILED DESCRIPTION

Figure 1:
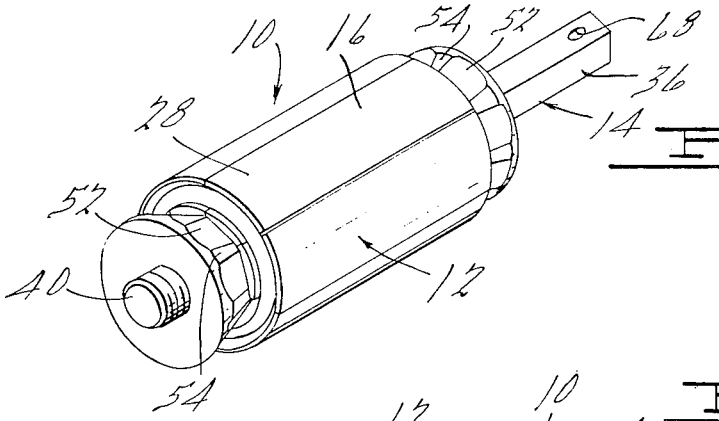
FIG. 1 is a perspective view of an expander tool embodying the present invention.
Figure 2:
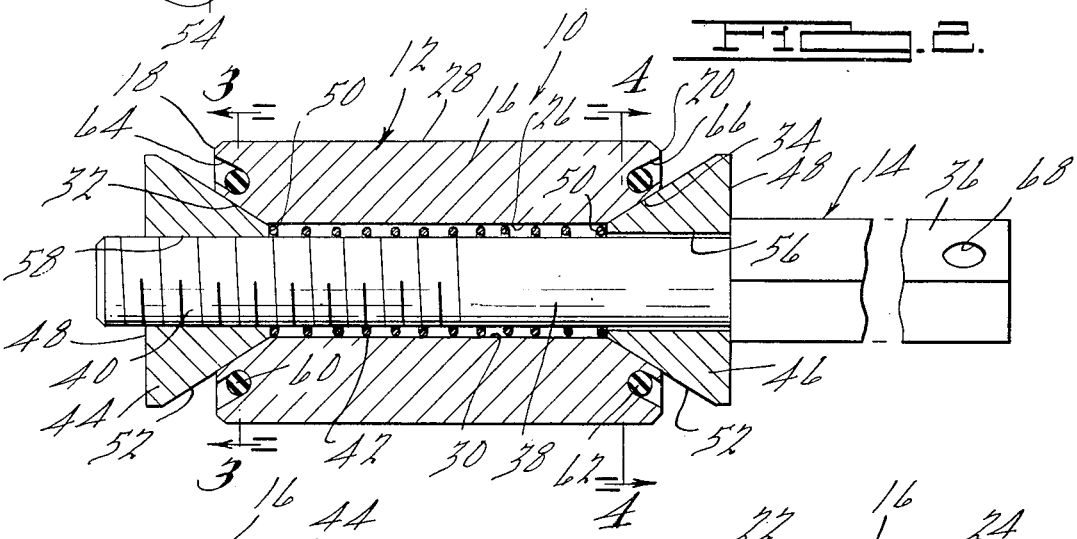
FIG. 2 is a longitudinal sectional view, with portions broken away, of the expander tool illustrated in FIG. 1, showing the same in the unexpanded condition.
Figure 3:
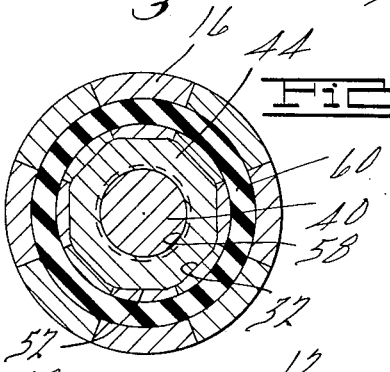
FIG. 3 is a transverse cross-sectional view of the structure illustrated in FIG. 2, taken on the line 3—3 thereof.
Figure 4:
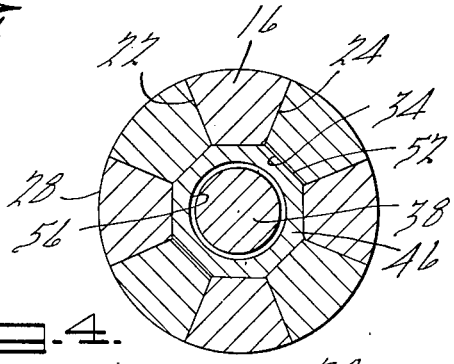
FIG. 4 is a transverse cross-sectional view of the structure illustrated in FIG. 2, taken on the line 4—4 thereof.

Referring to the drawings, a preferred embodiment of the invention is illustrated in FIGS. 1 through 6 thereof and is comprised of an expander tool, generally designated 10, having an elongate, uniformly cylindrically expansible body portion, generally designated 12, and an actuating member, generally designated 14. The body portion 12 of the tool 10 is comprised of a plurality of similar expansion segments 16 which may be made of steel or other suitable material having sufficient strength to withstand the forces exerted thereon. Eight expansion segments 16 are utilized in the preferred embodiment of the invention illustrated, although it will be understood that a greater number of segments may be utilized if desired. Each of the expansion segments 16 includes end walls 18 and 20, radially outwardly diverging flat side walls 22 and 24, and inner wall 26, and a convex outer wall 28. The expansion segments 16 comprising the body portion 12, when assembled as illustrated in FIGS. 1 through 6, define a bore 30 extending axially through the body portion 12, and in accordance with the present invention, the opposite ends of the expansion segments are provided with longitudinally inwardly extending, radially inwardly angled flat, planar walls 32 and 34, which when the body portion is assembled as illustrated in FIGS. 1 through 6, provide angular flat planar wedge surfaces defining interior truncated pyramidal recesses at each end portion of the body, the surfaces or walls 32 and 34 merging into the walls 26 defining the bore 30.

The actuating member 14, which may also be made of steel or other suitable material having sufficient strength to withstand the forces exerted thereon, is substantially longer than the body portion 12 and a portion of the actuating member extends through the bore 30 in spaced relationship with respect to the walls 26 defining the bore 30. The actuating member 14 includes an elongate handle portion 36 at one end thereof, the handle portion preferably being of hexagonal or other non-circular cross-section to facilitate the application of a wrench or other torque applying means thereto and also facilitating convenient adjustable positioning of the tool in the muffler or tail pipe. The actuating member 14 also includes a relatively short, smooth shank portion 38 adjacent to and extending inwardly from the handle portion 36, and a relatively long externally threaded portion 40, the shank portion 38 and the threaded portion 40 extending through the bore 30 in spaced relationship with respct to the walls 26 defining the bore 30 and with the distal end of the threaded portion 40 projecting beyond the end of the body portion 12 remote from the handle portion 36.

In accordance with the present invention, a coil compression spring 42 is provided which is disposed in the bore 30 and circumposed on the shank and threaded portions 38 and 40 of the member 14, the spring 42 having a loose fit in the bore 30. A pair of generally frusto-pyramidal wedge members 44 and 46 are provided which are circumposed on the threaded and shank portions 40 and 38, respectively, of the member 14 at the opposite ends of the body 12. The wedge members 44 and 46 each have outer ends 48 which are larger in diameter than the diameter of the bore 30 and inner ends 50 which are smaller in diameter than the diameter of the bore 30. In accordance with the present invention, each of the wedge members 44 and 46 are provided with eight planar wedge surfaces 52 which are of generally trapezoidal configuration and constitute segments of the surface of a pyramid and which are angled so as to be complementary to the flat planar wedge surfaces 32 and 34 at the opposite ends of the body portion 12. The edge portions of the wedge surfaces 52 blend smoothly with a slight radius with the edge portion of the adjacent wedge surface so that the angularly spaced, segmental pyramidal surfaces 52 are separated from each other throughout the length thereof by angularly spaced segments of conical surfaces 54 as shown in FIG. 1 on a greatly enlarged scale for clarity of illustration and description, the surfaces 52 being flat planar surfaces while the surfaces 54 are convex and may, for example, be formed on a radius of 0.010 inches. With such a construction, clutch means is thereby provided for connecting the wedge members 44 and 46 to and disconnecting such wedge members from the expansion segments 16 thereby enabling the wedge members 44 and 46 to spin relative to the expansion segments 16 if excessive torque is applied to the actuating means 14 thereby preventing over-expansion of the tool and also preventing cocking or twisting of the expansion segments relative to each other. The wedge member 46 is preferably shorter than the smooth shank portion 38 of the member 14 and defines a smooth bore 56 therethrough adapted to receive the shank portion 38, while the wedge member 44 defines an internally threaded bore 58 which threadably engages the externally threaded portion 40 of the member 14.

In order to contract the body portion 12 by forcing the segments 16 radially inwardly and toward each other to maintain the body 12 in assembled relationship, contactile resilient means is provided which, in the preferred embodiment of the invention illustrated, comprises resilient and stretchable O-rings 60 and 62 which are preferably formed of oil, grease and heat resistant material and which are seated in inwardly canted grooves 64 and 66 which are formed in the end walls 18 and 20, respectively, of each of the segments 16 and curvilinearly aligned when the segments are assembled. With such a construction, the outer surfaces 28 of the segments are unencumbered and smooth throughout the length thereof. It will be understood that other resilient contractile means may be provided for maintaining the body 12 in assembled relationship. For example, O-rings or circular springs may be disposed in aligned annular grooves provided in the exterior surfaces of the segments intermediate the ends thereof.

If desired, the handle portion 36 may be provided with a transversely extending passageway 68 therethrough adapted to receive a cross handle or rod (not shown) to facilitate the application of torque to the member 14.

Figure 5:
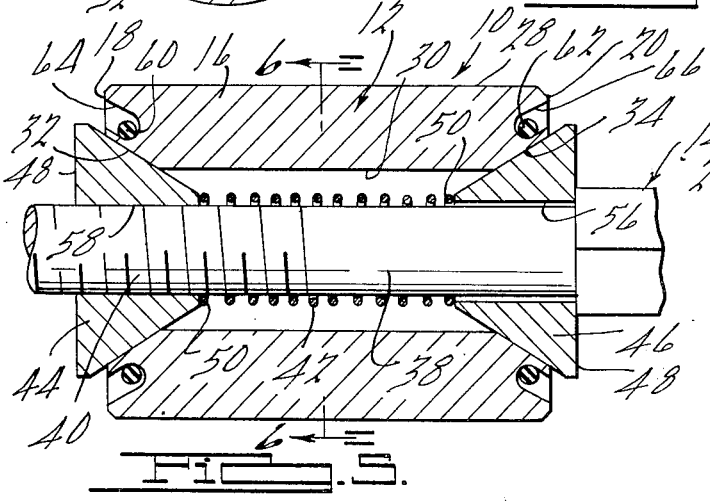
FIG. 5 is a longitudinal cross-sectional view, similar to FIG. 2, but illustrating the tool in the expanded condition.
Figure 6:
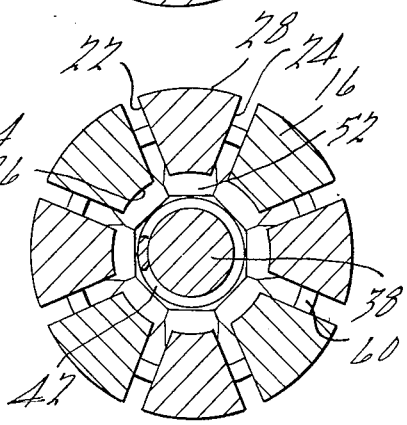
FIG. 6 is a transverse cross-sectional view of the structure illustrated in FIG. 5, taken on the line 6—6 thereof.

In the operation of the tool 10, the previously described components thereof are assembled as illustrated in FIGS. 1 through 4, and the body portion 12 is inserted in the thin walled tubular workpiece, such as an engine muffler or tail pipe. Torque is then applied to the actuating member 14 so that the wedge members 44 and 46 are drawn toward each other through the agency of the threaded connection between the threaded portion 40 of the actuating member 14 and the wedge member 44. As the wedge members 44 and 46 move toward each other, the complementary planar, mating, wedge surfaces 32, 34 and 52 insure that the wedging or expansion forces are applied uniformly and evenly to each of the segments 16 thereby insuring uniform circumferential expansion of the body portion 12, as illustrated in FIGS. 5 and 6, and preventing twisting of the segments 16 relative to each other which could cause jamming of the tool. The clutch means, as previously described, prevents over expansion of the tool which could also cause jamming of the tool in the workpiece.

As the wedge members 44 and 46 move toward each other, the inner ends 50 of the wedge members engage the adjacent ends of the coil spring 42 and compress the spring in a longitudinal direction thereby storing energy in the spring 42. The spring 42 is of a length such that the convolutions thereof move into abutting relationship and form a solid stop to prevent the wedge members from entering so far into the bore 30 as to cause the body portion 12 to over expand beyond the effective tool range, the spring 42 thus preventing further movement of the wedge members into the body 12 in the event an over expansion condition should occur.

When it is desired to remove the tool 10 from the workpiece, the actuating member 14 is rotated in the opposite direction whereupon the energy stored in the spring 42 tends to force the wedge members 44 and 46 longitudinally outwardly of the bore 30 against the opposing frictional forces tending to hold the surfaces 52 of the wedge members 44 and 46 in wedging engagement with the surfaces 32 and 34 of the segments 16. Such a construction thus assists in contracting the body, the easy removal of the tool from the workpiece, and prevents jamming of the tool in the workpiece.

While a preferred embodiment of the invention has been illustrated and described, it will be understood that various changes and modifications may be made without departing from the spirit of the invention.

What is claimed is:

1. In an expander tool, the combination including a cylindrical body comprised of at least eight circumferentially disposed separate segments defining an axial bore extending through said body, resilient means carried by said segments for maintaining said segments in expansible assembled relationship, said segments each having longitudinally and radially inwardly canted planar surfaces at each end thereof, an actuating member extending through said bore, said actuating member including a threaded portion and a smooth shank portion located at opposite ends of said body, combined expansion and clutch means including a first wedge member threadably engaging said threaded portion of said actuating member, said first wedge member having at least eight angularly spaced segmental pyramidal surfaces separated by at least eight equally angularly spaced segmental conical surfaces, said pyramidal surfaces on said first wedge member being engaged with said planar surfaces at one end of each of said segments, said combined expansion and clutch means also including a second wedge member slideably circumposed on said shank portion of said actuating member, said second wedge member having at least eight angularly spaced segmental pyramidal surfaces separated by at least eight equally angularly spaced segmental conical surfaces, said pyramidal surfaces on said second wedge member being engaged with the planar surfaces at the other end of each of said segments.

2. The combination as set forth in claim 1 including coil spring means disposed in said bore and circumposed on said actuating member intermediate said wedge members, the length of said spring being such that the convolutions thereof move into abutting relationship and form a solid stop to prevent said wedge members from entering into the bore defined by said body beyond a predetermined distance.

* * * * *